US006119796A

United States Patent [19]

Schmid

[11] Patent Number: 6,119,796

[45] Date of Patent: Sep. 19, 2000

[54] PNEUMATIC SPRING PERCUSSION MECHANISM WITH AN AIR SUPPLY

[75] Inventor: Wolfgang Schmid, Munich, Germany

[73] Assignee: Wacker-Werke GmbH & Co., KG, Germany

[21] Appl. No.: 09/341,086

[22] PCT Filed: May 14, 1998

[86] PCT No.: PCT/EP98/02855

§ 371 Date: Jun. 30, 1999

§ 102(e) Date: Jun. 30, 1999

[87] PCT Pub. No.: WO99/01259

PCT Pub. Date: Jan. 14, 1999

[30] Foreign Application Priority Data

Jul. 4, 1997 [DE] Germany ..... 197 28 729

[51] Int. Cl.[7] ..... B65D 11/04

[52] U.S. Cl. ..... 173/201; 173/118; 173/212

[58] Field of Search ..... 173/201, 200, 173/122, 118, 121, 210, 212, 14

[56] References Cited

U.S. PATENT DOCUMENTS

| | | | |
|---|---|---|---|
| 3,688,848 | 9/1972 | Vick et al. | 173/118 |
| 4,066,136 | 1/1978 | Wanner et al. | 173/201 |
| 4,442,906 | 4/1984 | Simpson | 173/122 |
| 4,657,088 | 4/1987 | Grossman et al. | 173/201 |
| 4,828,046 | 5/1989 | Pyatov | 173/14 |
| 5,161,623 | 11/1992 | Erlach | 173/212 |
| 5,435,397 | 7/1995 | Demuth | 173/201 |

FOREIGN PATENT DOCUMENTS

| | | |
|---|---|---|
| 1 267 273 | 11/1961 | France . |
| 255 977 | 5/1912 | Germany . |
| 567 911 | 10/1973 | Switzerland . |
| 932 275 | 7/1963 | United Kingdom . |

*Primary Examiner*—Scott A. Smith
*Attorney, Agent, or Firm*—Boyle Fredrickson Ziolkowski S.C.

[57] ABSTRACT

A double action pneumatic spring percussion mechanism has an air supply mechanism. A percussion piston is movable with a driving piston. In an air-supply position, ambient air is supplied through an air inlet to a front pneumatic spring. When the percussion piston and driving piston are moved accordingly relative to each other, a loading hole is opened, through which air under increased pressure can flow out of the front pneumatic spring into a rear pneumatic spring, ensuring an increase of pressure in the rear pneumatic spring. The air pressure increase in both pneumatic springs makes it possible to use the pneumatic spring percussion mechanism even in conditions of operation with a low ambient air pressure.

8 Claims, 1 Drawing Sheet

PNEUMATIC SPRING PERCUSSION MECHANISM WITH AN AIR SUPPLY

BACKGROUND OF THE INVENTION

1. Field of the Invention

The invention relates to a pneumatic spring percussion mechanism in accordance with the preamble of patent claim 1 and to a percussion hammer and/or hammer drill in which a pneumatic spring percussion mechanism of this type is used.

2. Description of the Related Art

Pneumatic spring percussion mechanisms, in particular for use in percussion hammers and/or hammer drills, are generally known. In a pneumatic spring percussion mechanism of this type a driving piston is set into an oscillating axial movement by a suitable drive, for example a crank assembly connected to an electric motor. In a particularly advantageous design, the driving piston is hollow. A percussion piston is inserted into the cavity in the driving piston with a pneumatic spring forming at least between an end surface of the percussion piston and the cavity in the driving piston. Owing to the inertia of the percussion piston, the movement of the driving piston initially produces a positive pressure in the pneumatic spring, which pressure is used to drive the percussion piston in the direction of a tool fastened on the hammer/drill. After the percussion piston has struck against the tool or against a riveting set arranged between the percussion piston and tool, it rebounds. In the pneumatic spring the reverse movement of the driving piston, which movement is produced by the crank assembly, causes suction to be exerted on the percussion piston, the suction assisting the recoil produced during the blow and exerted on the percussion piston whereupon the percussion piston moves away from the tool. After the upper dead center of the driving piston is reached, said driving piston again moves in the opposite direction toward the tool, retards the percussion piston, which is still in the reverse movement, and accelerates it again onto the tool in order to carry out the next blow.

Apart from the single-sided pneumatic spring percussion mechanisms which have just been described, percussion mechanisms having a double pneumatic spring are also known in which a pneumatic spring is formed between the percussion piston and driving piston not just behind the percussion piston—as seen in the percussion direction but also in front of the percussion piston. A two-sided pneumatic spring percussion mechanism of this type permits reliable starting and idling behavior.

FIG. 5 shows an example of a conventional percussion mechanism having a double pneumatic spring. A percussion piston 2 is inserted in a driving piston 1 which can be moved axially to and fro, for example, by a crank assembly (not shown) in a percussion mechanism housing (not shown). A front pneumatic spring 3 is formed in front of the percussion piston 2 and a rear pneumatic spring 4 is formed behind the percussion piston 2. The front and the rear pneumatic springs 3, 4 are supplied with air via a ventilation slot 5, which leads to the surroundings or into the crank housing, in the driving piston 1.

Owing to its inertia the percussion piston 2 follows the oscillation movement of the driving piston 1 with a constant time delay. As a result, during the forward movement of the driving piston 1 (direction of movement to the left in FIG. 5) an air pressure builds up in the rear pneumatic spring 4, which pressure finally likewise drives the percussion piston 2 in a forward direction where the percussion piston 2 strikes against a tool (not shown) or against a riveting set (not shown) and carries out the blow. Subsequently, because of the action of the crank assembly the driving piston 1 passes into a reverse movement (to the right in the figure), as a result of which a positive pressure builds up in the front pneumatic spring 3, which pressure likewise drives the percussion piston 2 in the reverse movement and reinforces the recoil produced by the blow. During each stroke movement of the percussion piston 2 a connection is produced between the ventilation slot 5 and one of the respectively unstressed pneumatic springs 3, 4, which makes it possible to even out the air. However, at low ambient air pressure, for example, at great operating heights, it is possible that the amount of air penetrating into the particular pneumatic spring 3, 4 is not sufficient to then build up a sufficiently strong air cushion.

Pneumatic spring percussion mechanisms therefore generally have the problem of the functioning of the percussion mechanism depending on the amount of air which is available, i.e. on the ambient air pressure or on the ambient air density. It is thus possible, for example, to optimally configure a percussion mechanism for use at sea level while the same percussion mechanism can only be used to a restricted extent at great heights.

This is because there is less amount of air available at relatively great heights to fill the pneumatic spring. The strain on the pneumatic spring and on the other elements of the percussion mechanism drive is thereby increased which in extreme cases can result in the percussion mechanism being damaged by the percussion piston and the driving piston knocking together, if the pneumatic spring lying between them contains insufficient air to ensure an adequate pressure for separating the percussion piston and driving piston.

German Patent 255 977 discloses a pneumatic spring percussion mechanism of the generic type which essentially has the features of the pneumatic spring percussion mechanism described with reference to FIG. 5.

CH 567 911 describes a percussion mechanism having a single-sided pneumatic spring, in which a percussion piston and a driving piston are arranged in an axially moveable manner in a fixed cylinder. Between the driving piston and the percussion piston there is formed a cavity which serves as the pneumatic spring and after each blow is supplied with air via a groove which is formed on the inside of the cylinder and extends in the percussion direction. The air is supplied from the surroundings via gaps in the housing to a cylinder interior which, as seen in the percussion direction, is arranged in front of the percussion piston and when the percussion piston is positioned appropriately can communicate with the pneumatic spring cavity through the groove.

The problem of an insufficient supply of air to the pneumatic spring if the percussion mechanism is used, for example, at great heights, also occurs in the case of the two last-mentioned pneumatic spring percussion mechanisms.

OBJECTS AND SUMMARY OF THE INVENTION

The invention is based on the object of indicating a pneumatic spring percussion mechanism which always operates reliably even at low ambient air pressure or low ambient air density.

According to the invention, the object is achieved by a pneumatic spring percussion mechanism in accordance with patent claim 1. Advantageous developments of the invention can be seen from the dependent claims. A pneumatic spring percussion mechanism according to the invention can be used particularly advantageously in a percussion hammer and/or hammer drill.

A pneumatic spring percussion mechanism according to the invention, having an axially movable driving piston, a percussion piston which is axially movable in the driving piston, a front pneumatic spring which is formed between the driving piston and a front side of the percussion piston and having a rear pneumatic spring which is formed between the driving piston and the percussion piston's rear side which is opposite the front side, the front pneumatic spring being supplied with air via a ventilation aperture leading from the front pneumatic spring to the surroundings, comprises the rear pneumatic spring being supplied with air via a charging aperture which connects the rear pneumatic spring to the front pneumatic spring, it being possible for the ventilation aperture and the charging aperture to be alternately opened and closed by the percussion piston during movement of the percussion piston.

The alternate opening and closing of the ventilation aperture and the charging aperture by the percussion piston oscillating in the axial direction in the driving piston produces a pumping movement and makes it possible for the front pneumatic spring, which serves after the blow to produce a restoring force which acts on the percussion piston and which can be designed such that it is somewhat weaker, to be ventilated in a first operating state. If the percussion piston is then moved further, expediently in the direction of a percussion point, it closes the ventilation aperture and opens the charging aperture, as a result of which a connection between the front and the rear pneumatic spring is opened and air—which in the meantime is compressed—can flow out of the front pneumatic spring into the rear pneumatic spring. This enables the air fillings in the two pneumatic springs involved to be permanently charged, as a result of which, on the one hand, losses due to leakage can be compensated for and, on the other hand, an ambient air pressure which is too low can be increased in the interior of the percussion mechanism. The amount of air in the percussion mechanism is thereby automatically regulated which makes it possible for the percussion mechanism to be used virtually everywhere irrespective of the ambient air pressure.

In a particularly preferred embodiment, the percussion piston can be moved in the driving piston into a ventilation position in which the ventilation aperture is open and the charging aperture is closed, while the percussion piston can otherwise be moved into a charging position in which the ventilation aperture is closed and the charging aperture is open. This ensures that the ventilation aperture and the charging aperture can be opened and closed alternately and air from the surroundings is only able to penetrate into the percussion mechanism if the percussion piston is situated in the ventilation position, while the rear pneumatic spring is charged only if the ventilation aperture to the surroundings is closed and the charging aperture is open.

In an advantageous manner, the percussion piston can be moved into the ventilation position if the amount of air in the rear pneumatic spring falls short of a predetermined amount. In this manner, an automatic, mechanical control is realized since only if there is too little air in the rear pneumatic spring and hence it is not possible for a sufficient air cushion to build up is the ventilation aperture opened and ambient air able to penetrate into the front pneumatic spring, which ambient air, on further movement of the percussion piston, is pumped into the rear pneumatic spring and thus the amount of air in the rear pneumatic spring increased. As soon as there is again a sufficient amount of air in the rear pneumatic spring to form an air cushion, the percussion piston is no longer able to reach the ventilation position since it is pushed back beforehand by the rear pneumatic spring. In this manner, penetration of further ambient air into the percussion mechanism and an inadmissible increase in air pressure are avoided. Only if the air pressure or the amount of air in the rear pneumatic spring is again reduced below the limit value because of losses due to leakage is the ventilation aperture opened and new charging possible.

In an advantageous manner, the percussion piston can be moved into the charging position during each working stroke. This enables a permanent compensation of pressure between the front pneumatic spring and the rear pneumatic spring and so at any rate if the front pneumatic spring has been supplied with ambient air part of this air can also benefit the rear pneumatic spring.

In a preferred embodiment, the front side of the percussion piston has a hammer neck in which the ventilation aperture is formed. The ventilation aperture is advantageously formed by a slot formed in the hammer neck. This enables the ventilation aperture to be produced by simple machining of the hammer neck or of the percussion piston, for example, by milling the slot with a disk milling cutter.

In another preferred embodiment, the charging aperture extends in the driving piston and is formed by a recess in an inner wall of the driving piston, which inner wall guides the percussion piston. Similarly as for the ventilation aperture, it is possible for the recess for the charging aperture to be produced, for example, by milling the generally cylindrically-shaped inner wall of the driving piston.

As already mentioned, it is particularly advantageous to equip a percussion hammer and/or a hammer drill with a drive and a pneumatic spring percussion mechanism of the invention which is connected to the drive. A percussion hammer and/or hammer drill of this type can be used under virtually any air pressures and thus any operating heights above sea level without adverse effects on the functioning of the pneumatic spring percussion mechanism, because of fluctuations in air pressure, being able to be established.

BRIEF DESCRIPTION OF THE DRAWINGS

These and further features and advantages of the invention are explained in more detail below with the assistance of the figures, in which.

DESCRIPTION OF THE PREFERRED EMBODIMENTS

Figure 1:
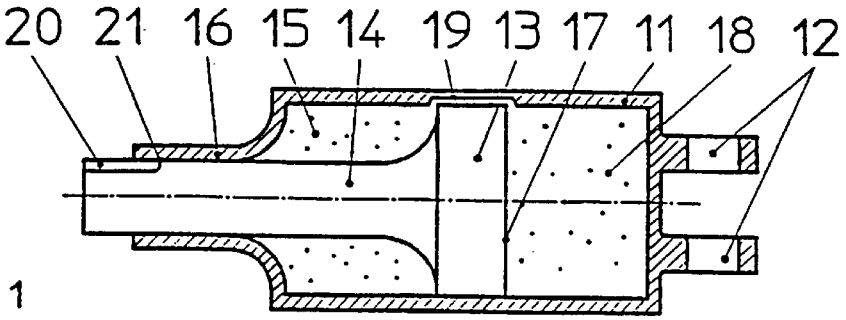
FIG. 1 shows a pneumatic spring percussion mechanism according to the invention at the beginning of the percussion action.

FIG. 1 shows a pneumatic spring percussion mechanism according to the invention.

A cylindrical driving piston 11 is inserted in an axially movable manner into the bore in a percussion mechanism housing (not shown). It is set into an oscillating translation movement, i.e. into a movement from left to right and vice versa in FIG. 1, via the lugs 12 by a crank assembly (not shown) which is connected to a motor.

Figure 5:
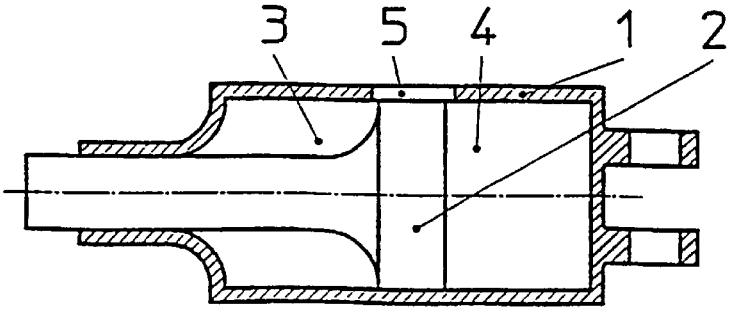
FIG. 5 shows a two-sided pneumatic spring percussion mechanism in accordance with the prior art.

A percussion piston 13 is inserted into the driving piston 11, only an outline of which is shown in FIG. 1, in a similar manner as in the case of the prior art described in conjunction with FIG. 5. For this purpose, the driving piston 11 has a generally cylindrically designed cavity into which the percussion piston 13 can be inserted. The percussion piston 13 has a hammer neck 14 which emerges on one side of the driving piston 11.

In order to form a front pneumatic spring 15, the driving piston 11 is sealed off from the hammer neck 14 by means of a seal 16. The seal 16 may, for example, consist of a flange element which is screwed onto the driving piston 11 and produces the sealing effect by means of a gap between the hammer neck 14 and the seal 16.

Opposite the front pneumatic spring 15 a rear pneumatic spring 18 is formed on a rear side 17 of the percussion piston 13. The functions of the front pneumatic spring 15 and the rear pneumatic spring 18 correspond to the functions of the front pneumatic spring 3 and rear pneumatic spring 4 already described for the prior art with reference to FIG. 5. However, in contrast to the prior art the rear pneumatic spring 18 does not have a direct connection to the surroundings but merely to the front pneumatic spring 15 via a charging aperture 19. The charging aperture 19 is formed in the inner wall of the driving piston 11 and has the form of a longitudinal groove. Depending on the embodiment it can be produced at the time of production of the unmachined part for the driving piston 11 by casting, or subsequently by milling or by another suitable manufacturing process.

The front pneumatic spring 15 can be brought into connection with the surroundings via a ventilation aperture 20 when the percussion piston 13 and the hammer neck 14 are appropriately positioned. The term "surroundings" in this context can be understood as meaning the operating surroundings of the percussion hammer and/or hammer drill in which the pneumatic spring percussion mechanism is fitted, or else a crank space (not shown) in which the driving piston 11 moves to and fro. The crank space is usually not completely sealed off from the operating surroundings and so essentially ambient air pressure prevails in the crank space.

FIG. 1 shows a position of the percussion piston 13 in which the charging aperture 19 is open and the ventilation aperture 20 is closed since the ventilation aperture 20 is not connected directly to the front pneumatic spring 15. In the following, this position is described as the starting position.

In the following, the manner in which the pneumatic spring percussion mechanism according to the invention functions is described with reference to FIGS. 1 to 4 which depict exemplary relative positions of the percussion piston 13 and the driving piston 11.

Figure 2:
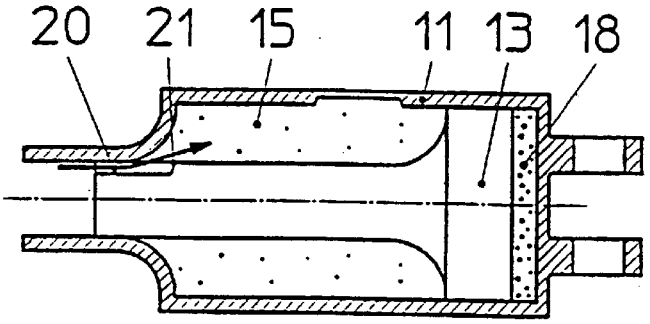
FIG. 2 shows the percussion mechanism at the instant of the greatest compression of the rear pneumatic spring with too little air filling.

From the starting position shown in FIG. 1 the driving piston 11 is moved by means of the crank assembly in the direction of an upper dead center (on the right in FIG. 2). The percussion piston 13 follows the movement of the driving piston 11 with some time delay and is still moving to the right in the direction of the upper dead center while the driving piston 11 is already moving in the direction of the lower dead center, i.e. in the forward direction to the tool (not shown in the figures) which would be arranged to the left of the percussion mechanism in the figures. As FIG. 2 shows, a highly compressed air cushion builds up in the rear pneumatic spring 18 because of the percussion piston 13 and the driving piston 11 moving toward each other. If the amount of air in the rear pneumatic spring 18 is too low, the air cushion is strongly compressed by the pistons 11, 13 involved to such an extent that a control edge 21 of the ventilation aperture 20 runs over the seal 16 and produces a connection between the front pneumatic spring 15 and the ventilation aperture 20 and hence the surroundings. The position of the percussion piston is described as the ventilation position. In the front pneumatic spring 15 a negative pressure has built up in the meantime because of the piston movement and so ambient air flows into the front pneumatic spring 15 and the front pneumatic spring 15 approximately reaches ambient air pressure.

Figure 3:
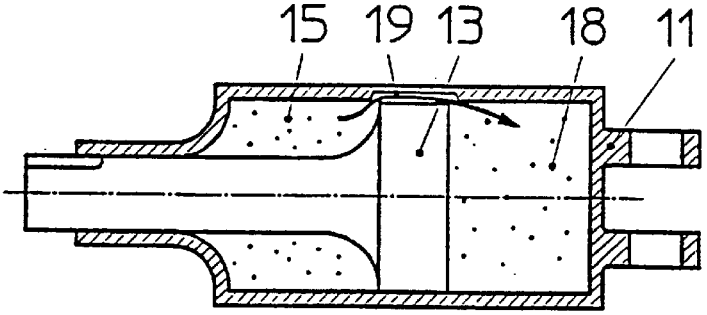
FIG. 3 shows the percussion mechanism at the instant of the percussion action during a charging procedure.

During the further movement, shown in FIG. 3, of the driving piston 11 the percussion piston 13 is driven forward, i.e. in the direction of the tool and in the position shown in FIG. 3 strikes against the tool (not shown) or against the riveting set (not shown).

The percussion position shown in FIG. 3 also corresponds to a charging position since in this position the charging aperture 19 is open and a connection between the front and the rear pneumatic springs 15, 18 is produced. As can be seen from the sequence of the figures, a positive pressure has in the meantime formed in the front pneumatic spring 15 and so air from the front pneumatic spring 15 flows into the rear pneumatic spring 18 via the charging aperture 19.

Figure 4:
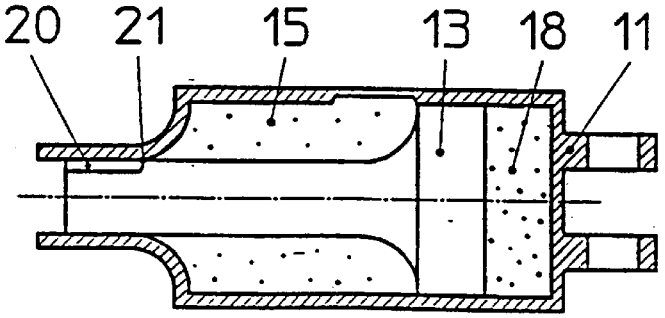
FIG. 4 shows the percussion mechanism at the end of the charging procedure at the instant of the greatest possible compression with the rear pneumatic spring filled correctly.

The charging procedure is ended by the renewed stroke movement of the driving piston 11 if the rear edge 17 has driven over the charging aperture 19 sufficiently far for the connection between the front and rear pneumatic springs 15, 18 to be interrupted. The air in the rear pneumatic spring 18 is subsequently compressed again, as is shown in FIG. 4.

Because of the charging of the rear pneumatic spring 18, i.e. because of the penetration of additional air, the air cushion is now strong enough to sufficiently support the percussion piston 13 with respect to the driving piston 11. As FIG. 4 shows, the control edge 21 in this case does not move sufficiently far into the driving piston 11 for the ventilation aperture 20 to be opened. The following stroke is accordingly carried out without ventilation and charging. Only if air has emerged from the percussion mechanism because of losses due to leakage, in particular between the seal 16 and the hammer neck 14 will the amount of air in the rear pneumatic spring 18 have diminished sufficiently for renewed charging to be required. As can easily be seen, this charging is then carried out automatically and repeated until the air cushion in the rear pneumatic spring 18 has reached the required strength.

As has already been described, the charging of the percussion mechanism has the effect that after each charging step has ended a higher air pressure than in the surroundings of the percussion mechanism prevails in the rear and front pneumatic springs 18, 15. This ensures reliable functioning of the percussion mechanism and hence of the percussion hammer and/or hammer drill in which the percussion mechanism is fitted, even if the ambient air pressure falls below an air pressure taken as a basis during the design of the percussion mechanism.

What is claimed is:

1. A pneumatic spring percussion mechanism, having an axially movable driving piston (11);

a percussion piston (13) which is axially movable in the driving piston;

a front pneumatic spring (15) which is formed between the driving piston and a front side of the percussion piston; and having a rear pneumatic spring (18) which is formed between the driving piston and a piston rear side (17) which is opposite the front side;

the front pneumatic spring being supplied with air via a ventilation aperture (20) leading from the front pneumatic spring to atmosphere, wherein the rear pneumatic spring (18) is supplied with air via a charging aperture (19) which connects the rear pneumatic spring to the front pneumatic spring (15), the ventilation aperture and the charging aperture being alternately opened and closed by the percussion piston (13) during movement of the percussion piston.

2. The pneumatic spring percussion mechanism as claimed in claim 1, wherein the percussion piston (13) is moveable into a ventilation position in which the ventilation aperture (20) is open and the charging aperture (19) is closed; and wherein the percussion piston is moveable into a charging position in which the ventilation aperture is closed and the charging aperture is open.

3. The pneumatic spring percussion mechanism as claimed in claim 2, wherein the percussion piston (13) is movable into the ventilation position if the amount of air in the rear pneumatic spring (18) falls short of a predetermined amount.

4. The pneumatic spring percussion mechanism as claimed in claim 2, wherein the percussion piston (13) is movable into the charging position during each working stroke.

5. The pneumatic spring percussion mechanism as claimed in claim 1, wherein the front side of the percussion piston (13) has a hammer neck (14) in which the ventilation aperture (20) is formed.

6. The pneumatic spring percussion mechanism as claimed in claim 5, wherein the ventilation aperture (20) is formed by a slot formed in the hammer neck (14).

7. The pneumatic spring percussion mechanism as claimed in claim 1, wherein the charging aperture (19) extends in the driving piston (11).

8. The pneumatic spring percussion mechanism as claimed in claim 7, wherein the charging aperture (19) is formed by a recess in an inner wall of the driving piston (11), which inner wall guides the percussion piston (13).

* * * * *